US006334609B1

(12) United States Patent
Chun

(10) Patent No.: US 6,334,609 B1
(45) Date of Patent: Jan. 1, 2002

(54) QUICK CLAMP AND RELEASE VISE

(75) Inventor: Lin Bin Chun, Taichung (TW)

(73) Assignee: Taiwan Rong Fu Industrial Co., Ltd., Taichung (TW)

( * ) Notice: Subject to any disclaimer, the term of this patent is extended or adjusted under 35 U.S.C. 154(b) by 0 days.

(21) Appl. No.: 09/734,168

(22) Filed: Dec. 12, 2000

(51) Int. Cl.[7] ..... B25B 1/10
(52) U.S. Cl. ..... 269/244; 269/329
(58) Field of Search ..... 269/244, 329, 269/242, 246, 71, 73

(56) References Cited

U.S. PATENT DOCUMENTS 4,231,557 A * 11/1980 Blachly ..... 269/139
4,412,676 A * 11/1983 Jackson ..... 269/101
5,673,905 A * 10/1997 Kiene ..... 269/238
5,683,077 A * 11/1997 Fink ..... 269/244
5,887,860 A * 3/1999 Hong ..... 269/225
6,152,437 A * 11/2000 Bauer et al. ..... 269/329
6,164,635 A * 12/2000 Chase et al. ..... 269/244

* cited by examiner

*Primary Examiner*—Joseph J. Hail, III
*Assistant Examiner*—Daniel Shanley
(74) *Attorney, Agent, or Firm*—Rosenberg, Klein & Lee

(57) ABSTRACT

A vise includes a base with a fixed jaw and a screw extends through the base and a movable jaw is connected to the screw. A frame is fixedly connected to the base and a first wedge ramp extends from the frame. A sleeve movably extends through the frame and a second wedge ramp extends from the sleeve. A spring is mounted to the screw and received in the sleeve. An end of the screw extends through the spring and extends from the hole in the frame. A crank handle is connected to the end of the screw. When the sleeve is rotated to match two respective high points of the two ramps, the sleeve and the screw are shifted and quickly clamp the object by movement of the screw.

6 Claims, 6 Drawing Sheets

QUICK CLAMP AND RELEASE VISE

FIELD OF THE INVENTION

The present invention relates to a vise that includes two wedge ramps respectively on a fixed frame and a sleeve so as to quickly move the jaw to clamp object by matching the high points of the two ramps.

BACKGROUND OF THE INVENTION

A conventional vise for generally includes a base through which a slide movably extends. A fixed jaw is connected to a top of the base and a screw extends through the slide on which a movable jaw is connected. A handle extends through an end of the screw so that the user may rotate the handle and the movable jaw moves toward the fixed jaw to clamp an object between the fixed jaw and the movable jaw. It is experienced that the handle is rotated a lot of revolutions to move the movable jaw because the threads of the screw. When the movable jaw touches the object, the user still has to hold the object to keep the desired position of the object and then further rotates the handle to securely clamp the object by moving the movably jaw. When releasing the clamp to change another direction of the object, the handle is again rotated several revolutions to back off the movable jaw. During the final revolutions, the user provides a lot of effort to clamp the object the movable jaw. When doing this action, the user bows his/her body so as to easily use his/her arm to rotate the handle, and this could shift the position of the object.

The present invention intends to provide a vise that includes a quick means to clamp or release the object by simply pulling a bar.

SUMMARY OF THE INVENTION

In accordance with one aspect of the present invention, there is provided a vise and comprising a base and a fixed jaw connected to the base. A screw extends through an end of the base and is connected to the other end of the base. A movable jaw is connected to the screw. A frame is fixedly connected to the base and has a hole defined therethrough. A first wedge ramp extends from the frame. A sleeve movably extends through the hole of the frame and a second wedge ramp extends from the sleeve and faces the first wedge ramp. A spring is received in the sleeve. An end of the screw extends through the spring in the sleeve and extends from the hole in the frame. A crank handle is connected to the end of the screw.

The primary object of the present invention is to provide a vise which employs two wedge ramps to achieve a purpose of quick clamping or releasing an object.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
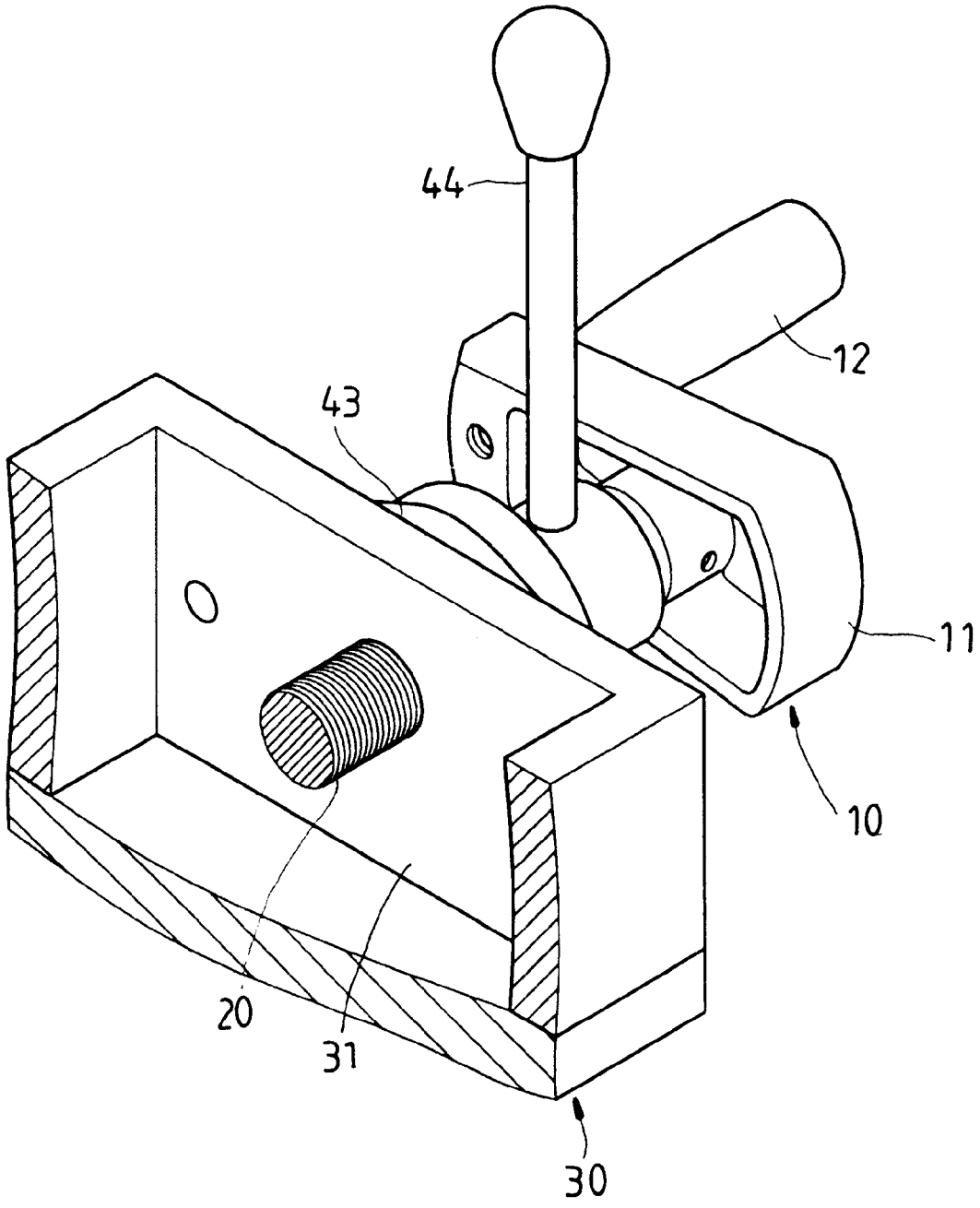
FIG. 1 is a perspective view to show a partial of a vise of the present invention.
Figure 2:
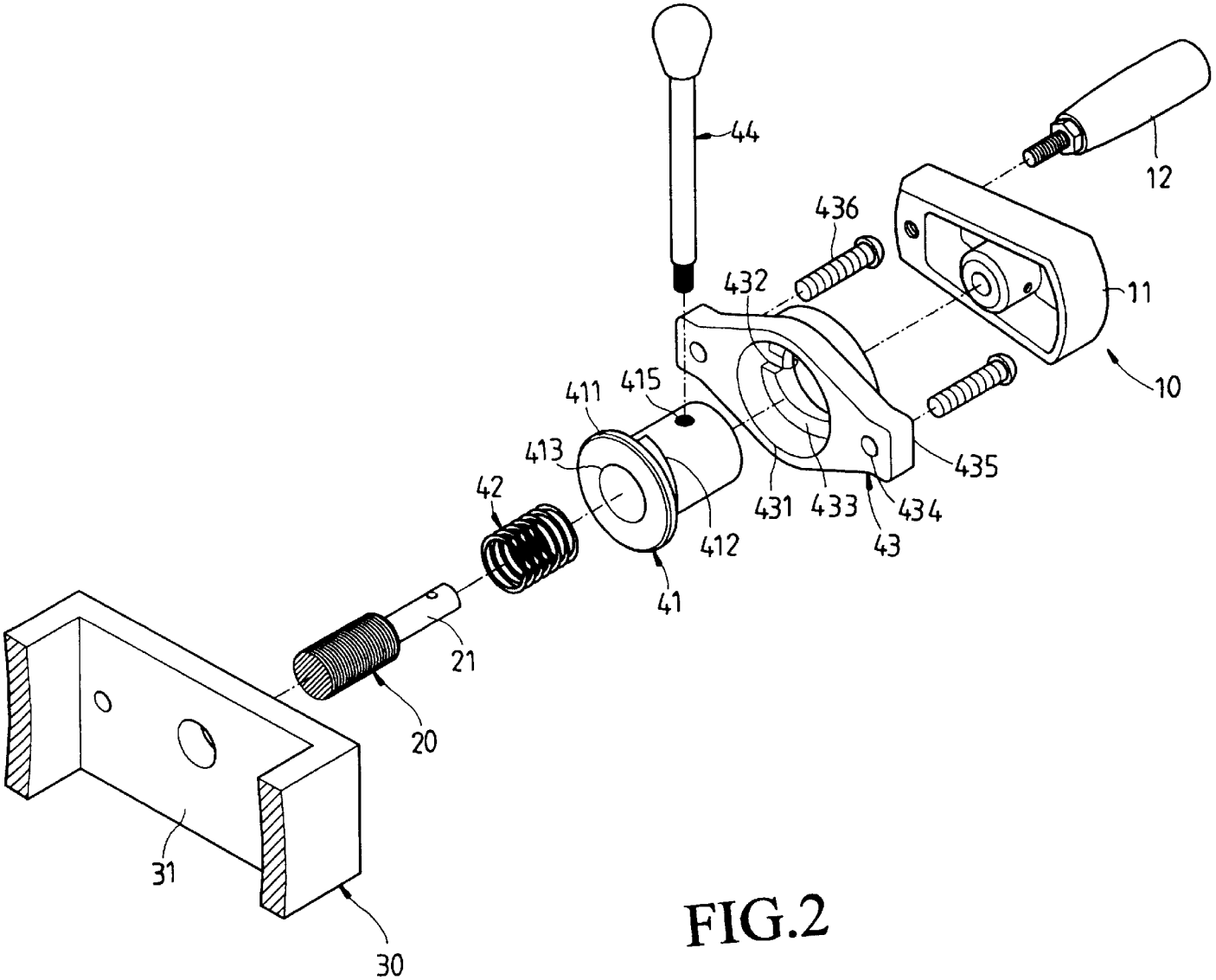
FIG. 2 is an exploded view to show the vise of the present invention.
Figure 3:
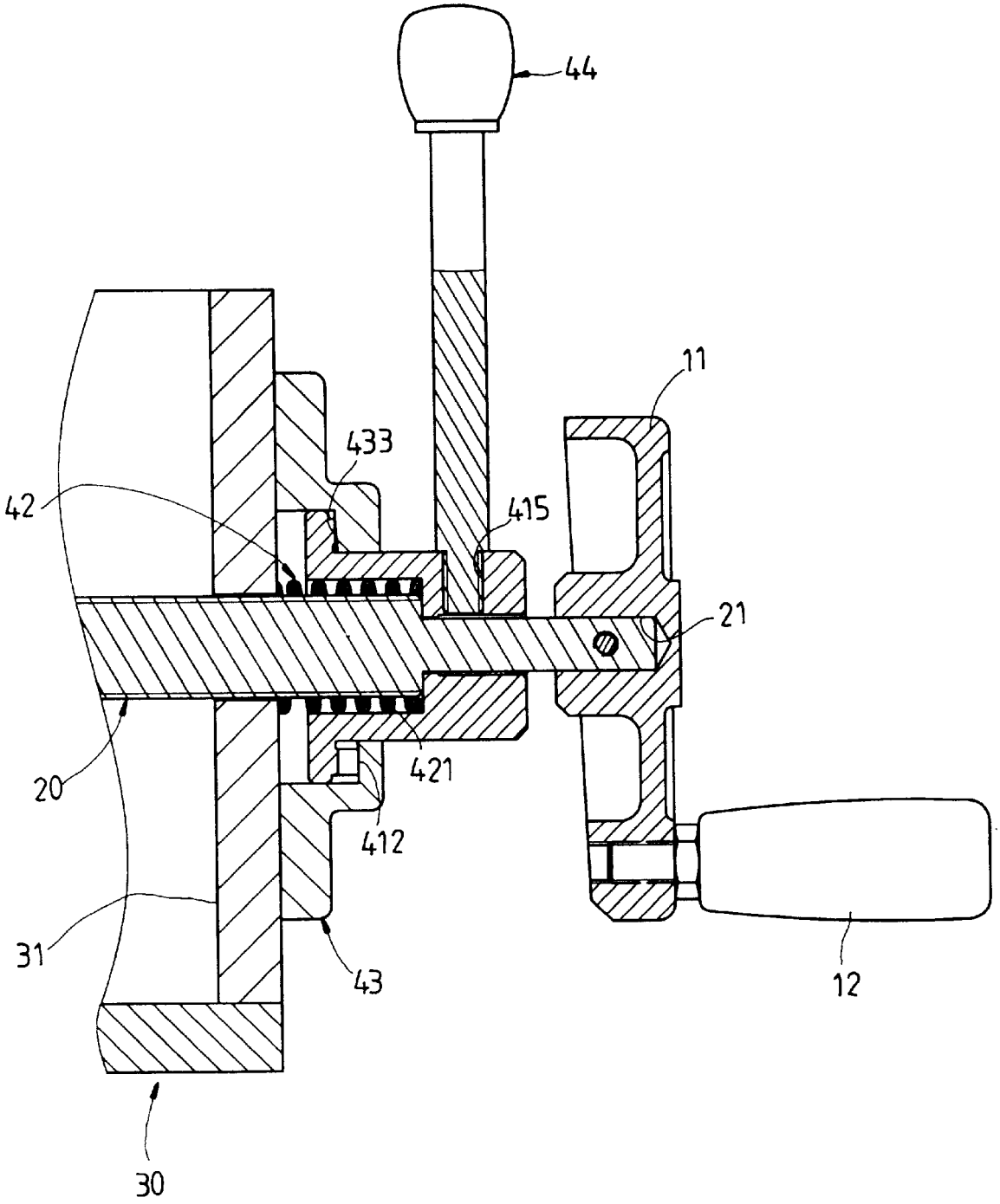
FIG. 3 is a cross sectional view to show the vise of the present invention.

Referring to FIGS. 1 to 3, the vise of the present invention comprises a base 30 with a fixed jaw connected to the base. A screw 20 extends through a hole in an end 31 of the base 30 and connected to the other end of the base 30. A movable jaw 32 is connected to the screw 20. A frame 43 has two apertures 434 defined therethrough and two bolts 436 extend through the apertures 434 and are engaged with the base 30. A hole 432 is defined through the frame 43 and a recess 431 is defined in the frame 43. A shoulder portion is connected between a periphery defining the recess 431 and a periphery defining the hole 432, and two first wedge ramps 433 (only one is shown) extend from the shoulder portion. A sleeve 41 movably extends through the hole 432 of the frame 43 and a flange 411 extends radially outward from the sleeve 41. Two second wedge ramps 412 (only one is shown) extend from a surface of the flange 411 and faces the first wedge ramp 433. A spring 42 is received in the sleeve 41. A plan section 21 extending from an end of the screw 20 extends through the spring 42 in the sleeve 41 and extends from the hole 432 in the frame 43. A stepped portion is defined in the sleeve 41 and engaged with the end from which the plan section 21 extends so that the screw 20 will be moved with the sleeve 41 toward the movable jaw 32. A crank handle 10 is connected to the plan section of the screw 20 wherein the crank handle 10 includes a connection member 11 and a handlebar 12 is connected to an end of the connection member 11.

Figure 4:
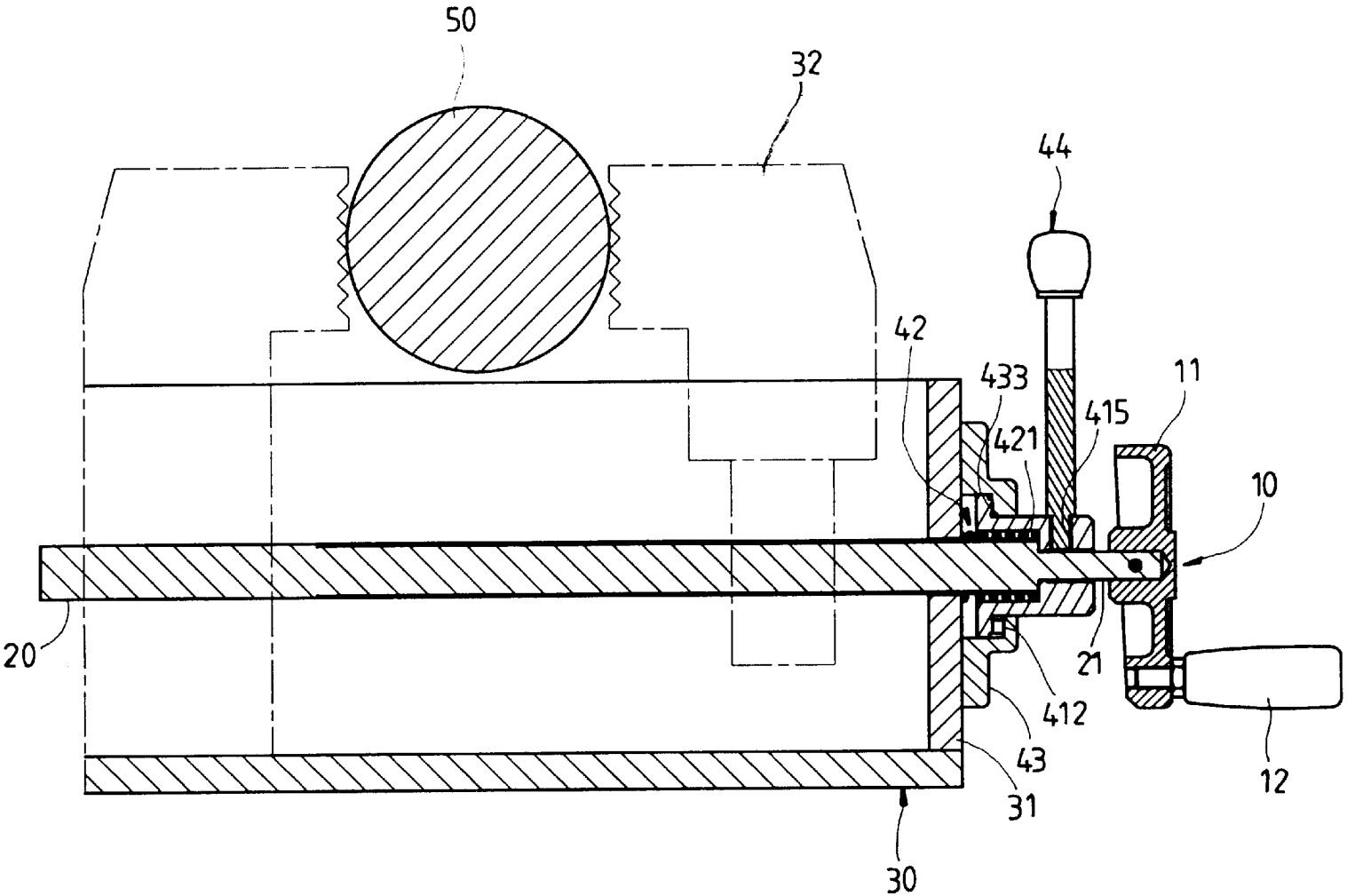
FIG. 4 is a cross sectional view to show that the movable jaw is moved by rotating the crank handle.
Figure 5:
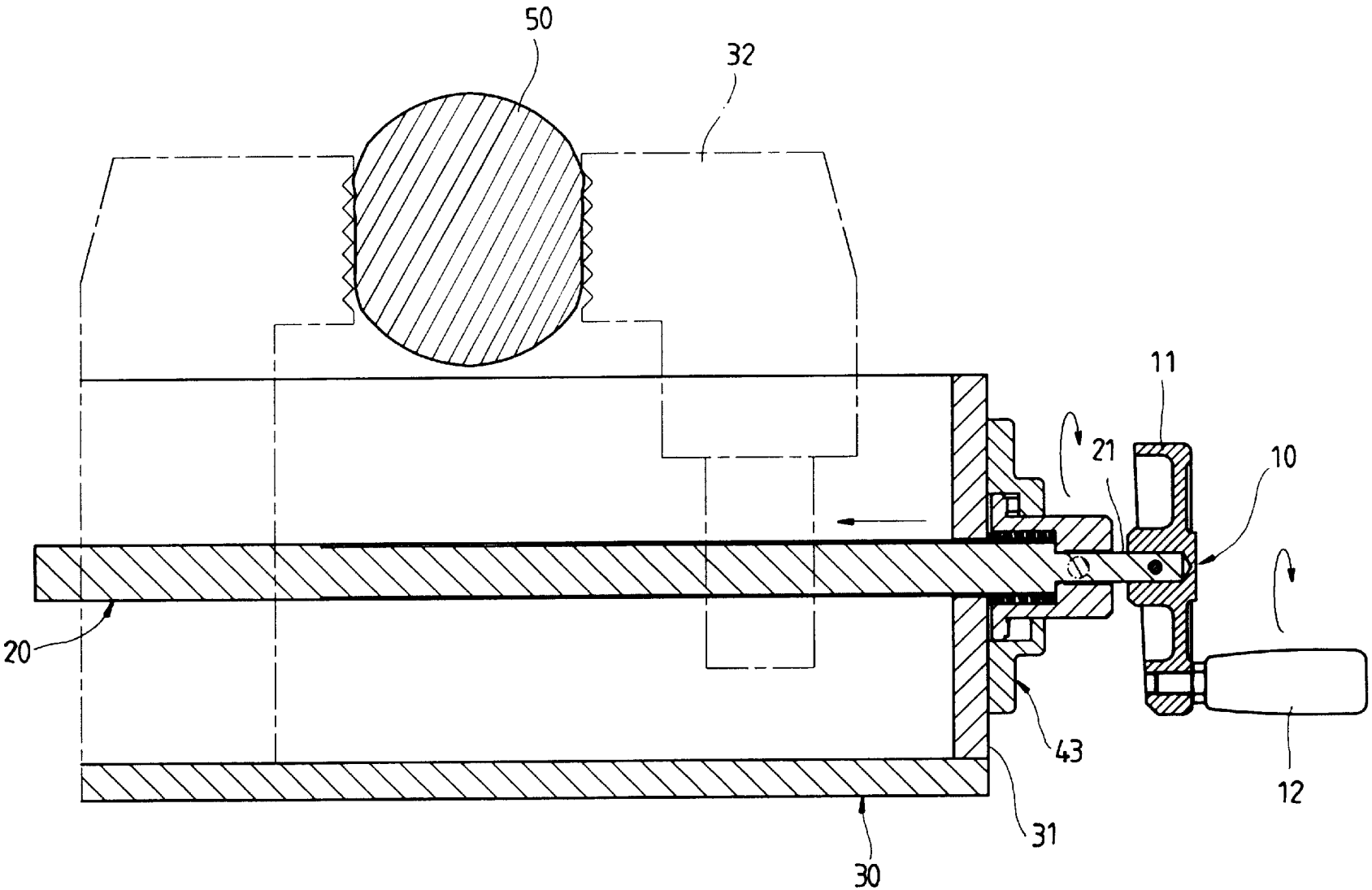
FIG. 5 is a cross sectional view to show that the movable jaw is quickly moved by rotating the bar.
Figure 7:
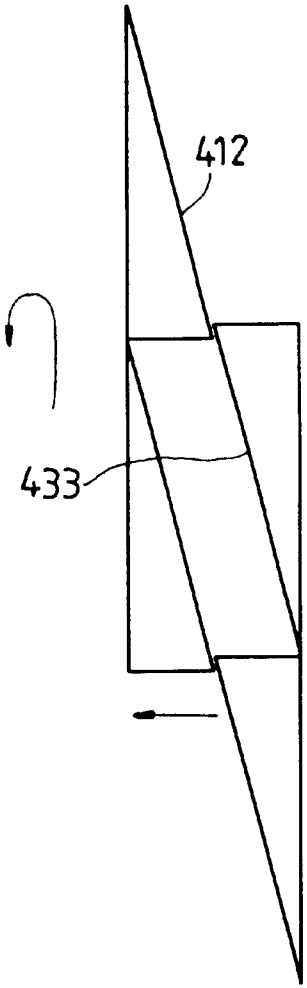
FIG. 7 is an illustrative view to show that the two wedge ramps are matched with each other at their high points.
Figure 6:
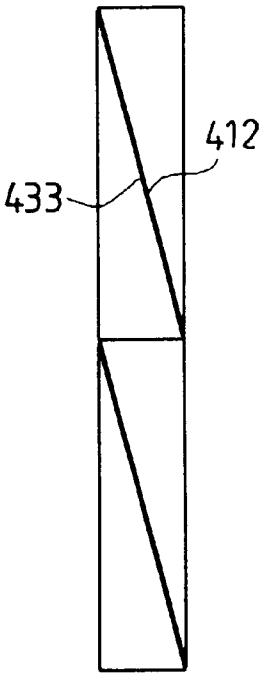
FIG. 6 is an illustrative view to show that the two wedge ramps are matched with each other at their low points.

A bar 44 has a threaded end and the sleeve 41 has a threaded hole 415 defined radially therein which is engaged with the threaded end of the bar 44 and the threaded end also contacts the plan section 21 of the screw 20. As shown in FIG. 4, the movable jaw 32 is moved toward the fixed jaw to clamp an object 50 as the way the conventional vises functioned. When the movable jaw 32 contacts the object 50, as shown in FIG. 5, the user pulls the bar 44 to rotate the sleeve 41. The wedge ramps 412, 433 move with each other and the high points of the first wedge ramps 412 match with the high points of the second wedge ramps 433 as shown in FIGS. 6 and 7. By this way, the movable jaw 32 and the screw 20 are both moved toward the object 50 so that the object 50 can be quickly secured by the vise. The object 50 is also released quickly by operating the bar 44 in opposite direction.

While we have shown and described various embodiments in accordance with the present invention, it should be clear to those skilled in the art that further embodiments may be made without departing from the scope and spirit of the present invention.

What is claimed is:

1. A vise comprising:

a base and a fixed jaw connected to said base;

a screw extending through an end of said base and connected to the other end of said base, a movable jaw connected to said screw;

a frame fixedly connected to said base and having a hole defined therethrough, a first wedge ramp extending from said frame;

a sleeve movably extending through said hole of said frame, a second wedge ramp extending from said sleeve and facing said first wedge ramp;

a spring received in said sleeve, an end of said screw extending through said spring in said sleeve and extending from said hole in said frame;

a crank handle connected to said end of said screw; and, a bar coupled to said screw to extend transversely therefrom through said sleeve.

2. The vise as claimed in claim 1 wherein said bar has a threaded end, and said sleeve has a threaded hole defined radially therein which is engaged with said threaded end of said bar.

3. The vise as claimed in claim 1 wherein said screw includes a plan section which extends from said hole of said frame and is connected to a connection member, a handlebar connected to an end of said connection member.

4. A vise comprising:

a base and a fixed jaw connected to said base;

a screw extending through an end of said base and connected to the other end of said base, a movable jaw connected to said screw;

a frame fixedly connected to said base and having a hole defined therethrough, a first wedge ramp extending from said frame, two apertures being defined through said frame, two bolts extending through said apertures and engaging said base;

a sleeve movably extending through said hole of said frame, a second wedge ramp extending from said sleeve and facing said first wedge ramp;

a spring received in said sleeve, an end of said screw extending through said spring in said sleeve and extending from said hole in said frame; and, a crank handle connected to said end of said screw.

5. A vise comprising:

a base and a fixed jaw connected to said base;

a screw extending through an end of said base and connected to the other end of said base, a movable jaw connected to said screw;

a frame fixedly connected to said base and having a hole defined therethrough, a first wedge ramp extending from said frame;

a sleeve movably extending through said hole of said frame, a second wedge ramp extending from said sleeve and facing said first wedge ramp, a flange extending radially outward from said sleeve, said second wedge ramp extending from a surface of said flange;

a spring received in said sleeve, an end of said screw extending through said spring in said sleeve and extending from said hole in said frame; and, a crank handle connected to said end of said screw.

6. A vise comprising:

a base and a fixed jaw connected to said base;

a screw extending through an end of said base and connected to the other end of said base, a movable jaw connected to said screw;

a frame fixedly connected to said base and having a hole defined therethrough, a first wedge ramp extending from said frame, a recess being defined in said frame, a shoulder portion connected between a periphery defining said recess and a periphery defining said hole, said first wedge ramp extending from said shoulder portion;

a sleeve movably extending through said hole of said frame, a second wedge ramp extending from said sleeve and facing said first wedge ramp;

a spring received in said sleeve, an end of said screw extending through said spring in said sleeve and extending from said hole in said frame; and, a crank handle connected to said end of said screw.

* * * * *